US005347662A

United States Patent [19]

Carper-White

[11] Patent Number: 5,347,662

[45] Date of Patent: Sep. 20, 1994

[54] ROTATABLE TOILET SEAT

[76] Inventor: Sharon Carper-White, 2942 B Fairview Ave., Parkersburg, W. Va. 26101

[21] Appl. No.: 35,810

[22] Filed: Mar. 23, 1993

[51] Int. Cl.[5] ..... A47K 13/00

[52] U.S. Cl. ..... 4/237

[58] Field of Search ..... 4/234, 237, 233, 578.1, 4/579, 254; 384/420, 427, 908

[56] References Cited

U.S. PATENT DOCUMENTS

| | | | |
|---|---|---|---|
| 1,328,900 | 1/1920 | Rownd . | |
| 2,872,256 | 2/1959 | Thomson | 384/420 |
| 3,203,008 | 8/1965 | Murcott . | |
| 3,209,376 | 10/1965 | Drury, Jr. . | |
| 4,030,787 | 6/1977 | Brogan et al. | 384/420 X |
| 4,214,323 | 7/1980 | Thomas . | |
| 4,615,055 | 10/1986 | Botes . | |
| 4,715,069 | 12/1987 | James . | |
| 4,734,942 | 4/1988 | Blanchard . | |
| 4,790,036 | 12/1988 | Vogeli et al. . | |
| 4,951,328 | 8/1990 | Potvin . | |
| 5,068,930 | 12/1991 | Ruggiero | 4/579 X |

FOREIGN PATENT DOCUMENTS

| | | | |
|---|---|---|---|
| 52034 | 2/1912 | Austria . | |
| 214183 | 10/1909 | Fed. Rep. of Germany . | |
| 0083870 | 7/1935 | Sweden | 4/233 |

*Primary Examiner*—Charles E. Phillips

*Attorney, Agent, or Firm*—Rothwell, Figg, Ernst & Kurz

[57] ABSTRACT

A rotatable toilet seat, for use by the disabled and non-disabled alike, is constructed of a base portion which mounts to a commode of standard design. A rotatable seat portion rides on top of the base portion on a slip disk. A latch provides extra security by permitting rotation only when engaged by the user. Retractable clips hold the seat portion to the base portion. Retracting the clips allows for easy disassembly for cleaning and replacement of parts.

6 Claims, 10 Drawing Sheets

ROTATABLE TOILET SEAT

FIELD OF THE INVENTION

The present invention relates to a rotatable toilet seat which is easily mounted to a commode of standard design. More particularly, this invention relates to a rotatable toilet seat well adapted for use by the physically disabled and the non-disabled alike. The rotatable toilet seat greatly facilitates the use of toilet facilities by the wheelchair bound.

DESCRIPTION OF THE RELATED ART

In the United States today there are approximately 20 million standard size toilet seats purchased annually. Although some of the seats are used for new construction, the majority are purchased as replacements for existing toilet seats.

There is also a very large orthopedic toilet industry. This industry produces a variety of products designed to assist physically challenged individuals when using a toilet. Such support products include: raised fixed position toilet seats, grab bars mounted on the toilet and/or toilet seat, and grab bars for mounting on walls near toilets. This industry tends to cater to individuals that have difficulty getting on and off a standard toilet.

There are many invisible barriers which prevent or deter the physically disabled from moving about the community. What may present an inconvenience or annoyance to the non-disabled public can present an insurmountable obstacle to the disabled or handicapped. Restroom facilities designed to aid the handicapped fortunately are becoming more commonplace, especially in public buildings and facilities. This has been largely due to the urging of the handicapped community and the action of the federal, state and local governmental authorities. The standard-design home or apartment bathroom, however, often is poorly suited for use by the wheelchair bound, and costly renovation often is necessary (although not always possible) to provide an acceptable alternative design. Thus, there remains a great need for improvements to restroom facilities for the handicapped.

An object of the present invention is to provide a rotatable toilet seat for use by both the handicapped and non-disabled public.

Another object of this invention is to provide a rotatable toilet seat which is easily mounted to a commode of standard design, without the need for special drilling or other special attachment procedures.

A further object of this invention is to provide a rotatable toilet seat which can be locked in a fixed position to prevent rotation when desired, yet be easily rotated when necessary.

Yet another object of this invention is to provide a rotatable toilet seat which is relatively simple in design and, accordingly, inexpensive to manufacture.

A further object of this invention is to provide a rotatable toilet seat that is easy to maintain and clean by the household user.

SUMMARY OF THE INVENTION

These and other objects are attained by the present rotatable toilet seat which, in a preferred embodiment, includes a base portion adapted to be mounted to a commode of standard design via hinges, with a rotating seat portion riding on top of and rotating about the base portion on an easily-removable slip disk that provides a continuous bearing surface. A latch mechanism interacts with the base and seat portions and operates in a first mode to permit free rotation of the seat portion on the base portion, and in a second mode whereby the seat portion is locked to the base portion to prevent rotation.

The present invention will be better understood by referring to the accompanying drawings and the Detailed Description of the Preferred Embodiment which follows.

DETAILED DESCRIPTION OF THE PREFERRED EMBODIMENT

Referring now to the accompanying drawings, the structure and function of the present invention, a rotatable toilet seat, will be readily apparent.

Figure 1:
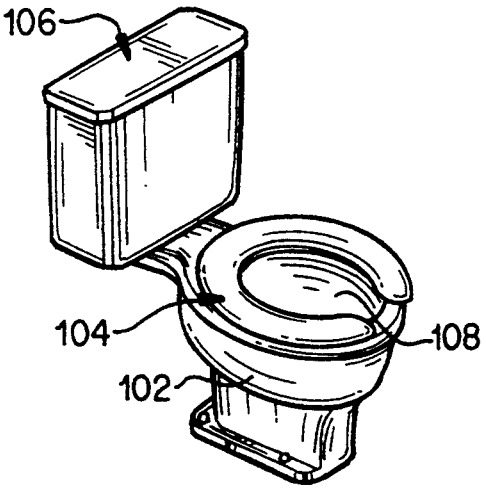
FIG. 1 PRIOR ART
FIG. 1 is a perspective view of a commode of standard design.

As seen in FIG. 1, the typical prior art toilet consists of a commode 102, a seat 104, and a tank 106, whereby the seat rests on the commode. Typically, the seat is mounted to the commode by hinges (not shown) so that it can be raised and lowered.

Figure 2D:
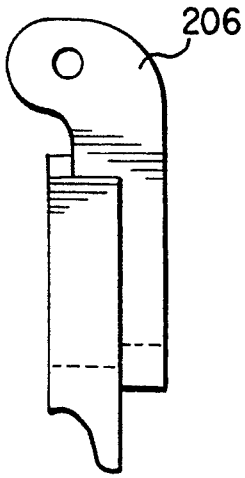
FIG. 2*d* is an enlarged view of a portion of the base portion illustrating the upper flange for connection to a standard commode.
Figure 2B:
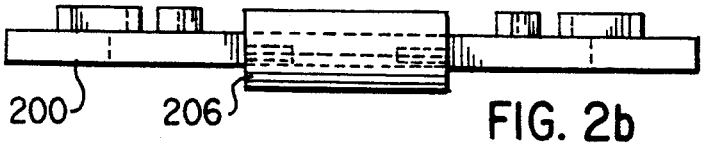
FIG. 2*b* is a front view of the base portion.
Figure 2A:
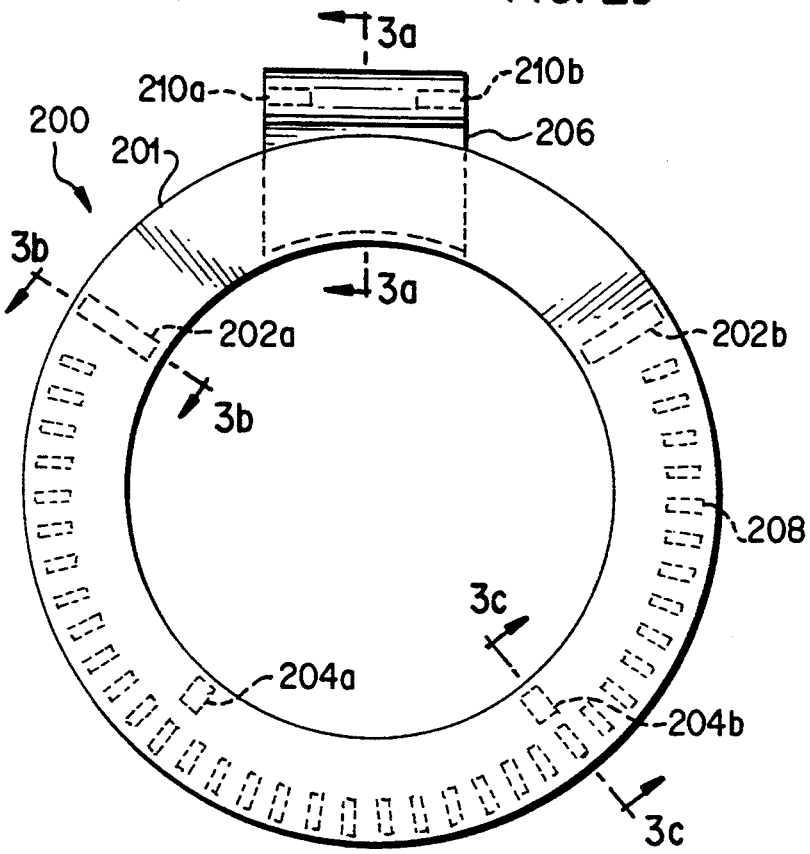
FIG. 2*a* is a top view of a rotatable toilet seat base portion of the present invention.

As seen in FIG. 2*a*, the present rotatable toilet seat comprises a base portion designated generally by reference numeral 200 and which is adapted for mounting on a standard size commode 102. In the preferred embodiments, base 201 is injection molded as a single piece, from an acrylonitrile butadiene styrene (ABS) thermoplastic resin. This material is resistant to chemicals, has excellent surface hardness and gloss as well as superb toughness, hardness and rigidity. All of these properties result in a product that is very durable and attractive while being cost effective.

Upper flange 206 is integral with the one piece base 201, and is configured for the attachment to a typical commode in a standard manner via hinges. The upper flange 206 contains hinge holes 210*a*, 210*b* for insertion of hinges (see FIGS. 9 and 10) which connect to the commode 102. Toilet seat base 201 has feet 202*a*, 202*b*, 204*a*, and 204*b* for contact with the commode. The feet 202*a*, 202*b*, 204*a*, 204*b* provide support for the toilet seat base 201. The feet rest on the rim of the commode 102 when the base is in the lowered position.

Figure 2C:
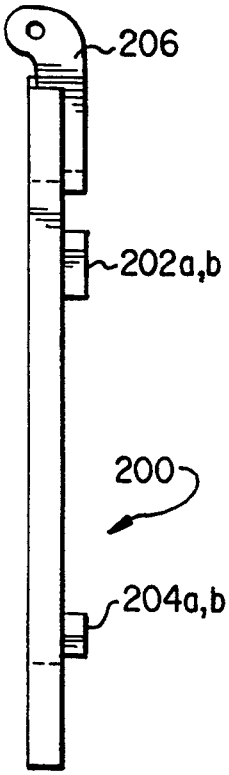
FIG. 2*c* is a side view of the base portion.

FIGS. 2*b* and 2*c* show top and side views respectively of toilet seat base portion 200.

Figure 3A:
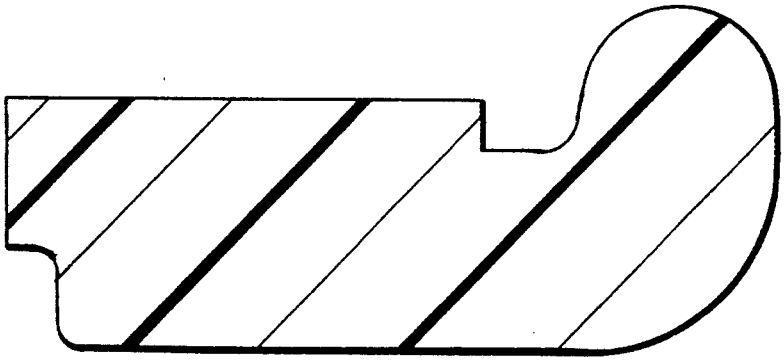
FIG. 3*a* is sectional view of the base portion along line A—A of FIG. 2*a*.
Figure 3B:
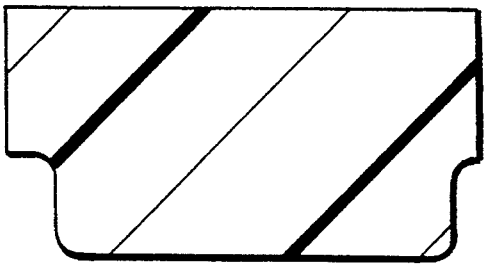
FIG. 3*b* is a sectional view of the base portion along line B—B of FIG. 2*a*.
Figure 3C:
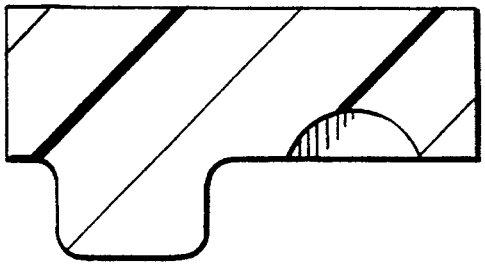
FIG. 3*c* is a sectional view of the base portion along line C—C of FIG. 2*a*.

Referring now to FIGS. 3*a–c*, the figures illustrate cross-sectional views of the toilet seat base 201 taken at various points. FIG. 3*a* illustrates a cross-sectional view taken through the upper flange 206 at line A—A of FIG. 2*a*. FIG. 3*b* illustrates a cross-sectional view taken along line B—B of FIG. 2*a* and through foot 202*a* at the rear portion of the toilet seat base 201. FIG. 3*c* illustrates a cross-sectional view of toilet seat base 201 taken along line C—C of FIG. 2*a*, through foot 204*b* and a slot 208 (explained below) on the underside of the toilet seat base 201.

Figure 4B:
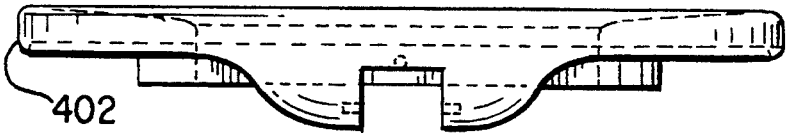
FIG. 4*b* is a front view of the seat portion of the present invention.
Figure 4A:
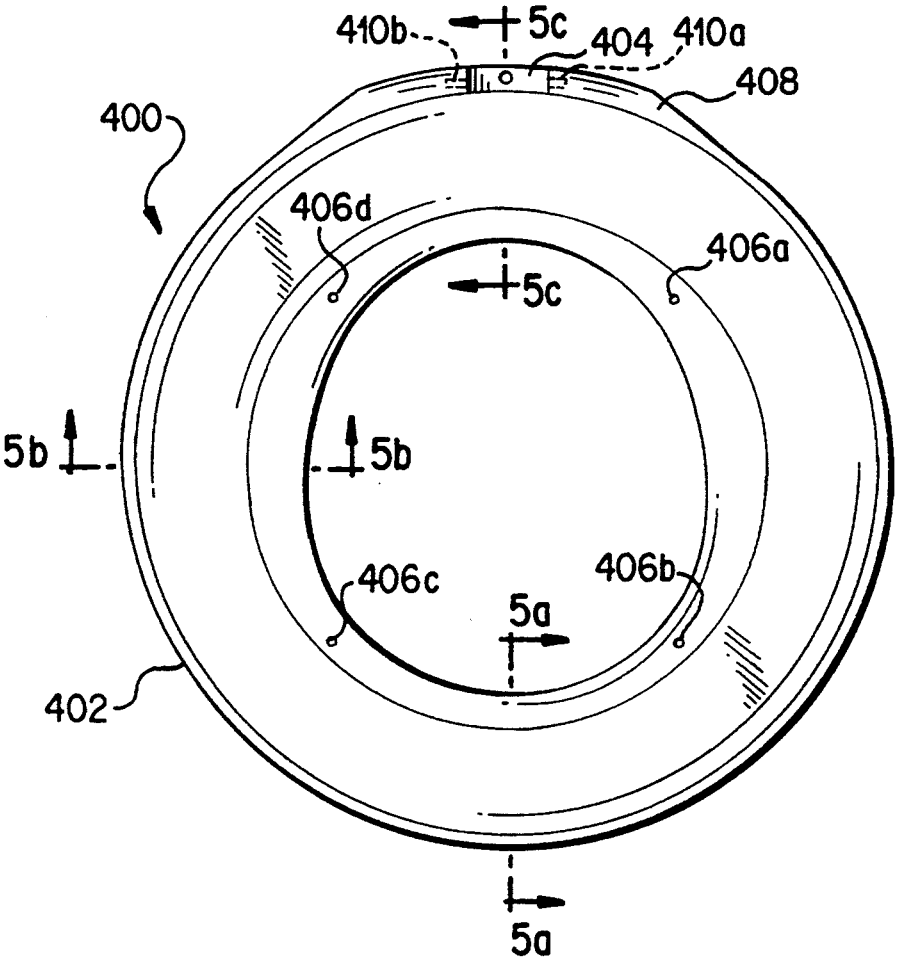
FIG. 4*a* is a top view of the rotatable seat portion of the present invention.

FIG. 4*a* illustrates a top view of the rotating seat portion, designated generally by reference numeral 400. Seat portion 400 includes a seat 402, with a front lip 408 protruding therefrom for attaching a latch as will be described. The appearance of toilet seat 402 is similar to that of a conventional seat. It is round and flat in nature with a hole through the middle. Spaced evenly around the inner diameter of seat 201 are four holes 406*a–d* where the toilet seat clamps (see FIGS. 8*a–8b*) are attached. In the preferred embodiment, seat 201 also is molded of ABS resin.

Figure 4C:
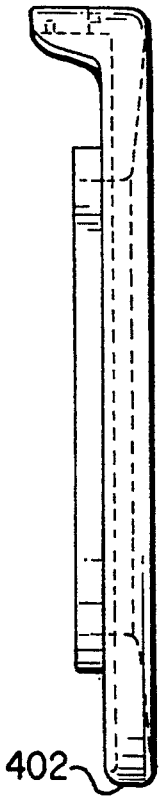
FIG. 4*c* is a side view of the seat portion of the present invention.

FIGS. 4*b* and 4*c* illustrate top and side views of toilet seat assembly 400.

Figure 5C:
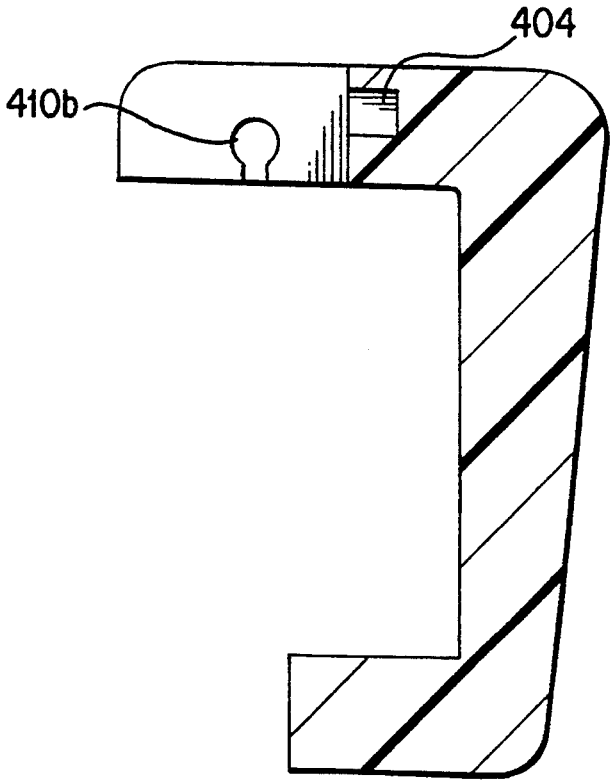
FIG. 5*c* is a sectional view along line D—D of FIG. 4*a*.
Figure 5B:
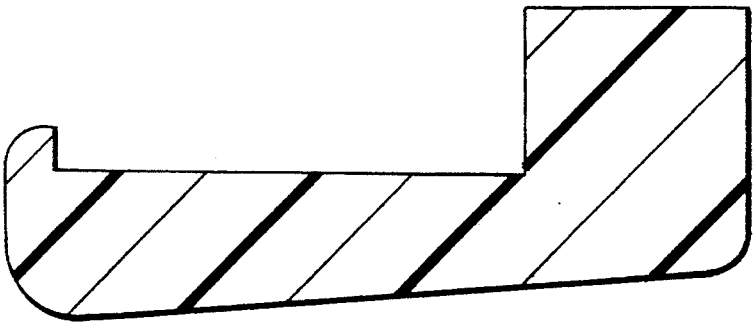
FIG. 5*b* is a sectional view along line E—E of FIG. 4*a*.
Figure 5A:
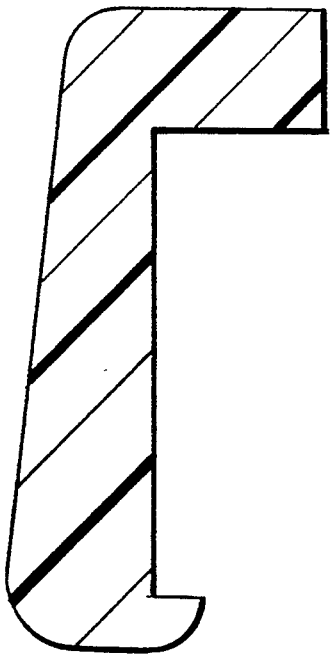
FIG. 5*a* is a sectional view of the seat portion along line F—F of FIG. 4*a*.

FIGS. 5*a* through 5*c* present cross-sectional drawings of the seat 402. FIG. 5*a* shows a cross-section taken along line F—F of FIG. 4*a*. FIG. 5*b* shows a cross-sectional view of toilet seat 402 taken across line E—E of FIG. 4*a*. FIG. 5*c* shows a cross-sectional view to the rear of toilet seat 402 taken across line D—D of FIG. 4*a*.

Figure 6B:
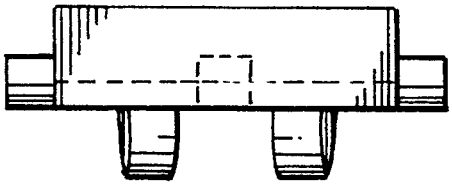
FIG. 6*b* is a front view of the latch of the present invention.
Figure 6A:
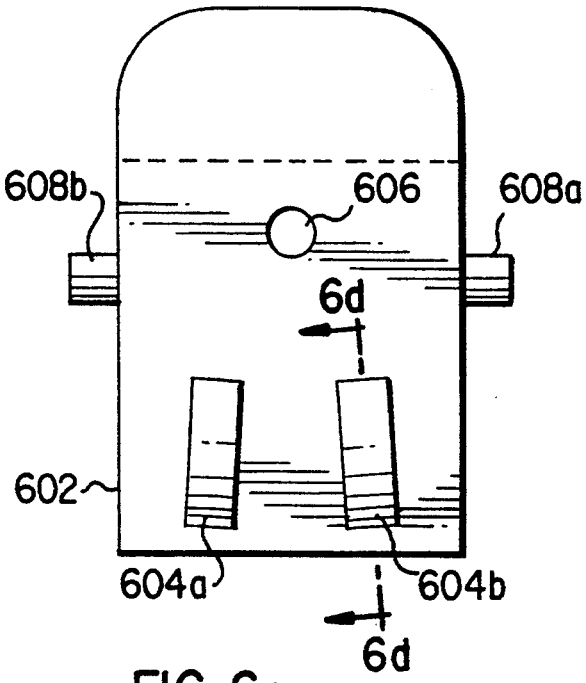
FIG. 6*a* is a top view of a latch of the present invention.
Figure 6C:
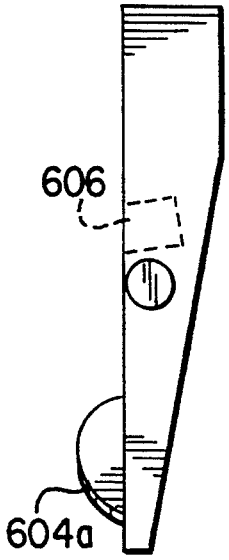
FIG. 6*c* is a side view of the latch of the present invention.
Figure 6D:
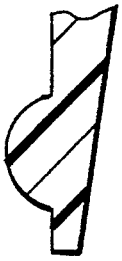
FIG. 6*d* is a sectional view along line G—G of FIG. 6*a*.

FIGS. 6*a–d* illustrate a preferred embodiment of a latch 602 for selectively locking the seat to the base to prevent rotation as desired by the user. In the preferred embodiment, latch 602, too, is molded in one piece from ABS. Latch 602 comprises protuberances 604*a–b* extending from the latch. The protuberances are angled with respect to the radial portion of the base 201, as seen in FIG. 6*d*, and in this preferred embodiment are generally disk-shaped. In any event, protuberances 604 are configured to mate with slots 208 on the underside of base 201. When the protuberances 604*a–b* are mated with corresponding slots 208, the seat 402 is locked in place and is prevented from rotating with respect to base 201. As apparent from the drawings, latch 602 is manually moved by the user between an engaged and a disengaged position.

Latch 602 contains a hole 606 for a spring (see FIGS. 7*a–7b*) which maintains tension on the latching mechanism. The latch is mounted to the seat portion 402 by inserting attachment tabs 608*a*, 608*b* into respective holes 410*a*, 410*b* in seat 402.

FIGS. 6*b* and 6*c* show top and side views respectively of latch 602. FIG. 6*d* shows a broken section taken along line G—G of FIG. 6*a*.

Figure 7B:
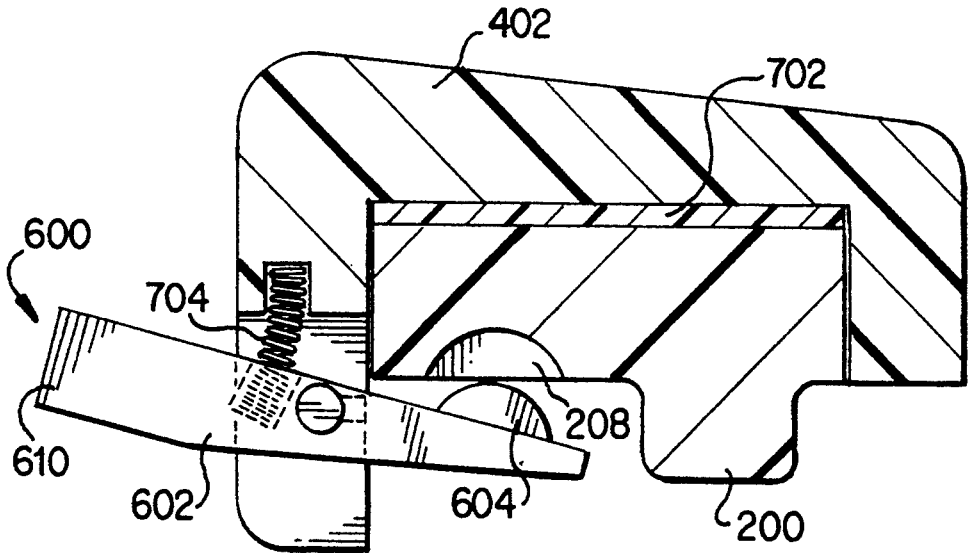
FIG. 7*b* is a cross-sectional view of the present invention with the latch in an unlocked position.
Figure 7A:
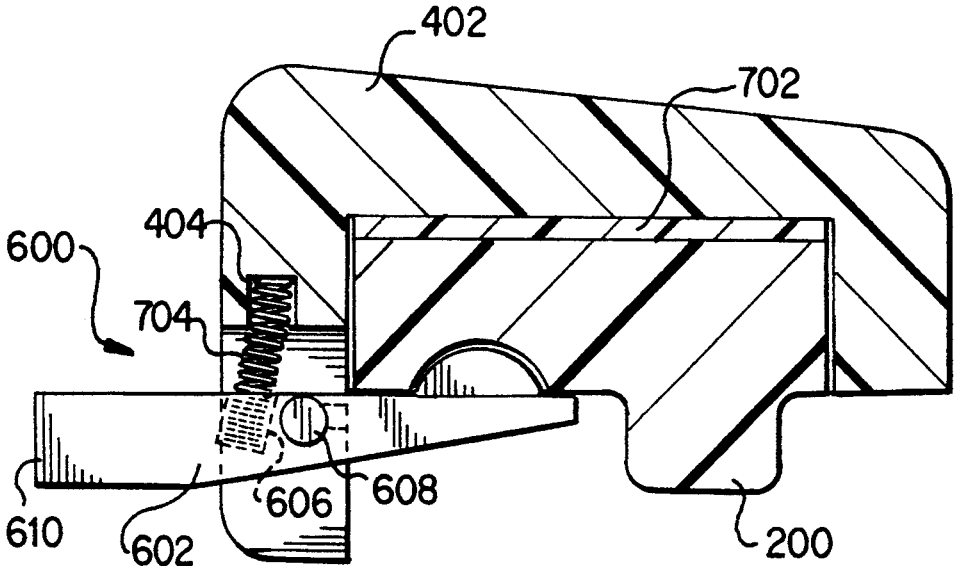
FIG. 7*a*is a cross-sectional view of the present invention with the latch in a locked position.

With reference now to FIGS. 7*a* and 7*b*, the previously mentioned seat portion 400 and base portion 200 are seen as united to comprise the present invention. Base portion 200, in use, will be mounted on a commode 102. Slip disk 702 is removably mounted on base portion 200 between the base portion 200 and the seat 402. The seat 402 has a downwardly extending flange. The flange has a cut-out portion for pivotally receiving a locking latch 602.

FIGS. 7*a* and 7*b* also illustrate the mounting of latch assembly 600 to the seat 402. Latch 602 is pivotably mounted to seat 402 by tabs 608*a*, 608*b* which are inserted in holes 410*a*, 410*b* of seat 402 (see FIG. 4*a*). One end of compression spring 704, which maintains latch 602 in the locked position seen in FIG. 7*b*, is inserted in hole 404 in seat portion 400. The other end of spring 704 is inserted into hole 606 provided in latch 602. Spring 704 maintains latch 602 in the locked position, with protuberances 604 mating with slots 208, until a user raises the handle portion 610 of latch 602 as seen in FIG. 7*b*.

Figure 8B:
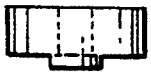
FIG. 8*b* is a front view a clip.
Figure 8A:
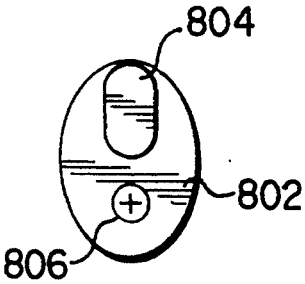
FIG. 8*a* is a top view of a clip for rotatably joining the seat portion to the base portion.

FIG. 8*a* illustrates a clip 802 for affixing seat 402 to base 200. Clip 802 has a hole 806 drilled through it for the mounting of a screw (not shown). The clip 802 contains a protrusion 804. In the preferred embodiment each toilet seat clip is molded from one piece of ABS. Clips 802 are mounted to toilet seat 402 one at a time to holes 406*a–d* with conventional screws (not shown) and stainless steel spring washers (also not shown) that are placed on the screws between seat 402 and the clips 802. The spring washer is used so that there will always be resistance on the clip 802, preventing it from swiveling out of position on its own. Clip 802 may be moved out of the way by compressing the spring washer and swiveling the clip around the screw. With the clip swiveled out of the way, toilet seat 402 may be removed and slip disk 702 and toilet seat base 201 may be removed, cleaned and/or replaced, as necessary.

Figure 8C:
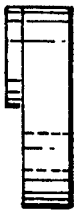
FIG. 8*c* is a side view of a clip.

FIGS. 8*b* and 8*c* are top and side views respectively of clip 802.

Figure 9B:
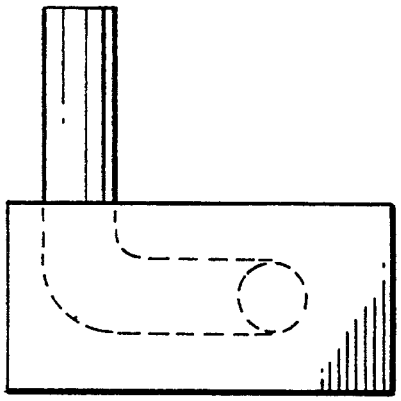
FIG. 9*b* is a front view of a right-hand hinge of the present invention.
Figure 9A:
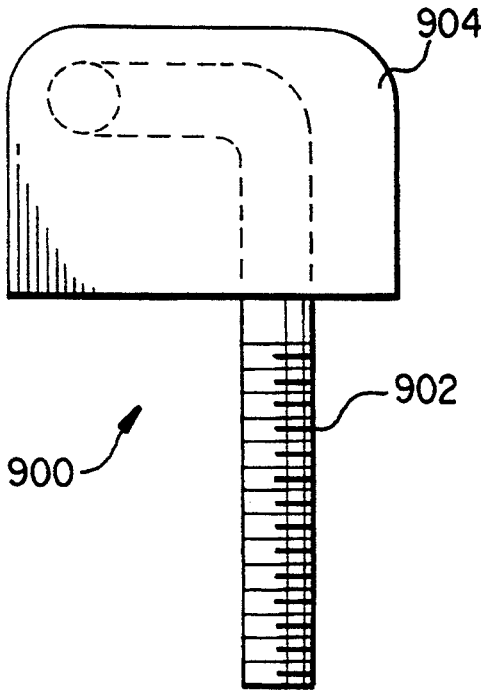
FIG. 9*a* is a top view of a right-hand hinge of the present invention.
Figure 9C:
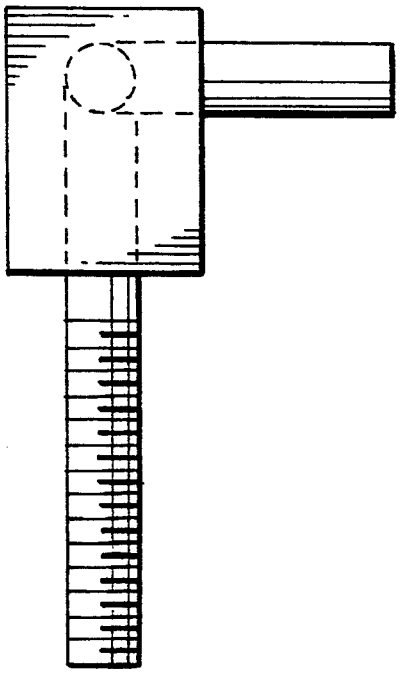
FIG. 9*c* is a side view of the right-hand hinge of the present invention.

FIG. 9*a* illustrates a hinge 900 for mounting the right-hand side of the toilet seat base 201 to the commode. Hinge 900 consists of steel rod 902 threaded and bent according to FIG. 9*a*, surrounded by an ABS molded portion 904. FIGS. 9*b* and 9*c* illustrate top and side views of hinge 900.

Figure 10B:
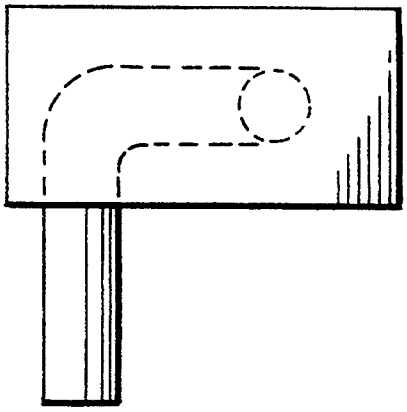
FIG. 10*b* is a front view of a left-hand hinge of the present invention.
Figure 10A:
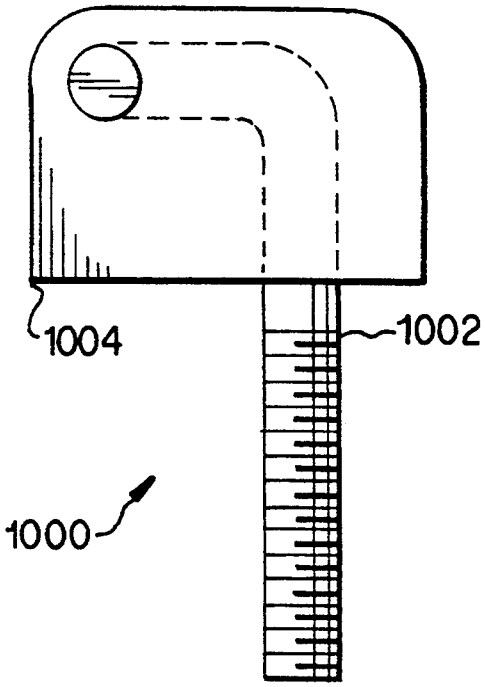
FIG. 10*a* is top view of a left-hand hinge of the present invention.

FIG. 10*a* illustrates a hinge 1000 for mounting to the left-hand side of base 201 to the commode. Hinge 1000 is the mirror image of, but otherwise identical to, right toilet seat hinge 900.

Figure 10C:
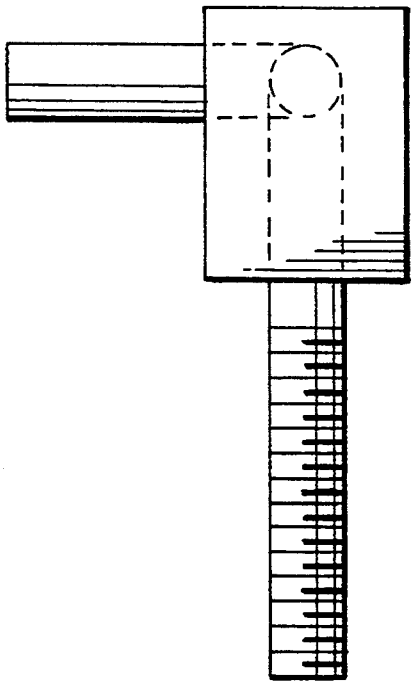
FIG. 10*c* is a side view of a left-hand hinge of the present invention.

Base 201 is mounted to the commode by inserting threaded bolts 902, 1002 through hinge holes 210*a–b* on base 201 and through the two standard mounting holes on the commode 102. The base is secured with conventional nylon nuts (not shown). FIGS. 10*b* and 10*c* illustrate top and side views of hinge 1002.

Figure 11B:
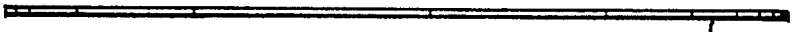
FIG. 11*b* is a front end view of a slip disk the present invention.
Figure 11A:
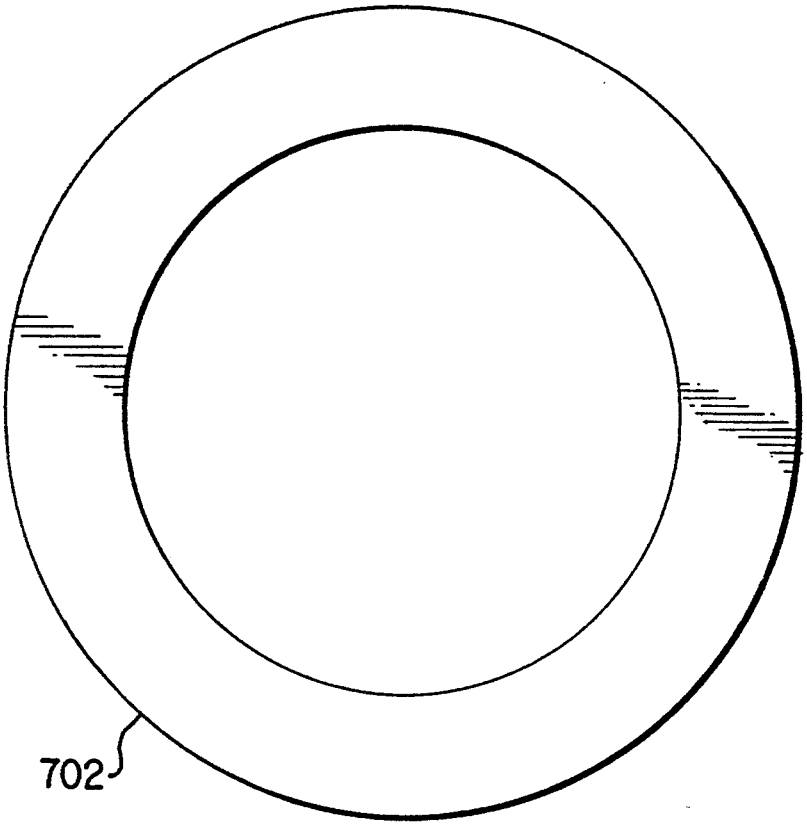
FIG. 11*a* is a top view of a slip disk of the present invention.

FIG. 11*a* illustrates a slip disk 702. Slip disk 702 preferably is molded of a high molecular weight polyethylene, or another material with a low coefficient of friction. The slip disk 702 rests on top of base 200, between the base and the seat 402 (as seen in FIGS. 7*a* and 7*b*). The disk provides a continuous bearing surface that allows seat 402 to rotate freely upon base 201. Slip disk 702 preferably has the same circumference as base 201, thus allowing the weight of the user to be distributed evenly upon the base.

An important feature of the invention is provided by having slip disk 702 be readily removable from between the base and seat portions. This feature permits the entire toilet seat assembly easily to be thoroughly cleaned and maintained in a sanitary condition. Slip disk 702 can be washed and returned to service—a feature not nearly as convenient were ball bearings or roller bearings employed between the seat and the base. This feature also permits the slip disk to be replaced, if needed, in a simple operation.

Operation

Figure 11C:
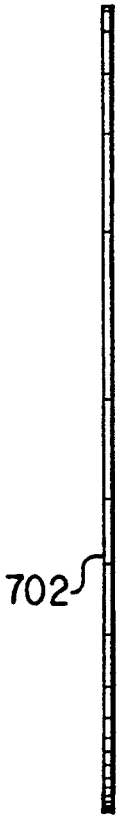
FIG. 11*c* is a side view of a slip disk of the present invention.

The rotating engagement of the seat portion 402 with base portion 201 is best seen in FIGS. 7*a* and 7*b*. Seat portion 402 rotates upon slip disk 702 installed on the upper surface of base portion 201. FIG. 11 shows details of the preferred slip disk 702.

As it frequently will be desired to prevent rotation of the seat portion (for example while a user is mounting and dismounting the seat), the rotatable toilet seat is provided with a latch mechanism. The latch mechanism, designated generally by reference numeral 602, provides a means whereby the user may easily and selectively permit or prevent rotation of the seat, according to his or her desires. Latch 602, when raised by the user, release the seat portion 402 from the base portion 201 to permit the desired free rotation. When latch 602 is released by the user, it assumes its normal position, under the influence of spring 704 wherein the seat portion 201 is locked to the base portion 402 to prevent rotation as shown in FIG. 7*a*.

In preferred embodiments, latch mechanism 602 can secure seat portion 402 against rotation in a plurality of positions. Thus, the user can mount the seat in a sideways position (for example, from a wheelchair) while the seat is locked, rotate the seat until she is facing forward and again lock the seat. When the user desires to dismount the commode, the seat portion is again unlocked, the user rotates the seat portion sideways, locks the seat against further rotation and dismounts onto her wheelchair.

One advantage of the rotating toilet seat of the present invention is that it allows users to approach the toilet from any direction. This is especially useful since grab bars and other support devices are usually mounted on walls adjacent to the toilet and not in front. The rotating toilet seat can be rotated toward a wall, allowing the users to stand facing the support bars to lower themselves down onto the toilet. The seat can be easily rotated to facilitate reaching toilet paper and/or flush handle. Rotating the seat toward the available grab bars after use enables the user to more easily raise himself up from the seat.

A further advantage of the rotating toilet seat is that it greatly assists users with restricted upper body mobility. Conditions such as arthritis can make the swiveling motion required for use of a standard toilet seat uncomfortable or even impossible. The present invention allows the user to freely rotate as necessary without discomfort.

A further advantage of the present invention is that it eliminates some forms of rest room renovation. Often existing rest rooms must be renovated to provide more space adjacent to the toilet to enable the users of wheelchairs and walkers easier access to the toilet from the side. By installing the present invention, the space in front of the toilet also serves as space adjacent to the toilet when the seat is rotated.

While the invention has been described in connection with certain preferred and alternative embodiments, it is not so limited. Modifications within the scope of the appended claims will be apparent to the artisan.

What is claimed is:

1. A rotatably toilet seat apparatus for use by the physically challenged, the apparatus comprising:

a base portion adapted to be secured to a commode and having an upper surface and a lower surface substantially conforming to the shape of the bowl of the commode;

a slip disk resting upon and removable from the upper surface of the base portion, wherein the slip disk has an upper surface that comprises a low-friction bearing surface; and a seat portion disposed upon the upper surface of the slip disk and rotatable with respect to the base portion while a user is sitting upon the seat portion, said seat portion having a top surface and a bottom surface, and a flange extending downwardly from the bottom surface, said flange having a cut-out portion with a locking latch pivotally secured therein, said locking latch having two opposite ends disposed on opposite sides of the flange such that movement of the one end of the latch in a first direction moves the other end of the latch in an opposite direction, the end of the latch disposed interior to the flange having at least one protuberance movable into and out of engagement with a plurality of slots formed in the lower surface of said base portion;

whereby the end of the locking disposed exterior to the flange can be manipulated to selectively engage the at least one protuberance with one of the plurality of slots in the lower surface of the base portion to position and lock the seat portion at any of a plurality of locations relative to the base portion.

2. A rotatable toilet seat apparatus of claim 1 wherein the latch further comprises spring means for biasing the latch in a position whereby the protuberance is mated with one of said slots.

3. A rotatable toilet seat apparatus of claim 1 wherein the slip disk is comprised of high density polyethylene.

4. A rotatable toilet seat apparatus of claim 1 further comprising hinge means for affixing the base portion to a commode, whereby the rotatable toilet seat apparatus can be raised and lowered while pivoting about the hinge means.

5. A rotatable toilet seat apparatus of claim 1 further comprising clips for removably securing the seat portion to the base portion while permitting the seat portion to rotate with respect to the base portion.

6. A rotatable toilet seat apparatus according to claim 1, wherein the slip disk is substantially coextensive with the entire upper surface of the base portion.

* * * * *